US006739324B2

(12) United States Patent
Hubert et al.

(10) Patent No.: US 6,739,324 B2
(45) Date of Patent: May 25, 2004

(54) COMPRESSED AIR DISTRIBUTOR

(75) Inventors: Leon Hubert, Jupille (BE); Robert Hubert, Liege (BE)

(73) Assignee: RDIH, Jupille (BE)

( * ) Notice: Subject to any disclaimer, the term of this patent is extended or adjusted under 35 U.S.C. 154(b) by 0 days.

(21) Appl. No.: 10/243,125

(22) Filed: Sep. 13, 2002

(65) Prior Publication Data

US 2003/0051717 A1 Mar. 20, 2003

(30) Foreign Application Priority Data

Sep. 14, 2001 (BE) ..... 2001/0598

(51) Int. Cl.[7] ..... F41B 11/32
(52) U.S. Cl. ..... 124/72; 124/73; 124/71
(58) Field of Search ..... 124/71, 72, 73, 124/74, 76, 75

(56) References Cited

U.S. PATENT DOCUMENTS 3,612,026 A * 10/1971 Vadas et al. ..... 124/76
4,819,609 A * 4/1989 Tippmann ..... 124/72
4,850,330 A * 7/1989 Nagayoshi ..... 124/76
4,936,282 A * 6/1990 Dobbins et al. ..... 124/74
5,349,938 A * 9/1994 Farrell ..... 124/73
5,363,834 A 11/1994 Stuchlik
5,400,536 A 3/1995 Milliman
5,497,758 A * 3/1996 Dobbins et al. ..... 124/73
5,613,483 A 3/1997 Lukas et al.
5,778,868 A * 7/1998 Shepherd ..... 124/76

* cited by examiner

*Primary Examiner*—Charles T. Jordan
*Assistant Examiner*—John W. Zerr
(74) *Attorney, Agent, or Firm*—Merchant & Gould, P.C.

(57) ABSTRACT

An automatic functioning device for distributing compressed gas comprises a jack and a distributor. The device successively and automatically carries out the following operations, after the piston has been initially hit on its rear end by a hammer:

forward piston displacement, compressed gas intake into the chamber and pressurization of the latter;

recoil of the piston to the rear, escape of compressed gas contained in the chamber and depressurization of the latter;

return of the piston to the front, closing of the compressed gas intake, escape to the front of the remaining compressed gas contained in the chamber and return of the device to its initial position.

10 Claims, 3 Drawing Sheets

COMPRESSED AIR DISTRIBUTOR

FIELD OF THE INVENTION

The present invention refers to an automatic compressed air or gas distributor located or not at the end of a jack piston and which, after having been activated, works automatically owing to the pressure and depression of the air into the jack.

The present invention also relates to a realization in the form of a kit, or integrated into any mobile assembly actuated by compressed air or pneumatic pressure (possibly a gas under pressure other than air).

STATE OF THE ART

Several types of compressed air distributors are already known, but all of them are actuated by mechanical, electromechanical or electronic means, without offering a possibility of automatic closing and admission of the compressed air according to an air pressure/depression, as well as the automatic release of the air at the time the jack piston returns back.

Weapons and more especially compressed air guns are the favorite technical field for such devices. Generally speaking, the air compressed by a mechanical mean, actuated by the operator at the time of loading (hand pump) or a compressed gas such as carbon dioxide contained in a cartridge, is released from a stocking chamber to the weapon barrel. This release is made by means of a valve actuated by pressure on the trigger.

For example, the U.S. Pat. No. 5,400,536 describes a double action pistol with a rotary cylinder, showing a jack in line with the barrel to fire projectiles. At the time of firing, a rod solid with the jack piston, is hit by the hammer with the effect to open the valve and to release a gas under pressure into the barrel.

The U.S. Pat. No. 5,613,483 discloses a piston and cylinder assembly for a gas weapon. The piston can move from backward to forward position between a loading position and a firing position. The piston moves through two chambers appearing in the cylinder. When the piston is in loading position, the cylinder communicates, via the first chamber, with a device supplying gas under pressure. This position of the piston prevents any communication between the two chambers.

On the other hand, in firing position, there is no longer communication between the first chamber and the gas supply, but there is a communication between the two chambers which allows the gas to pass from the first to the second chamber. To achieve that goal, the piston rod has a longitudinally located pass section at the connection with the cylinder.

Finally, U.S. Pat. No. 5,363,834 describes a weapon with a first operating mode for the launching of a projectile by means of compressed gas contained in a cartridge and a second operating mode for the launching by means of compressed air produced by a hand operated pump mechanism. The objective is to possibly remedy a failure in the device supplying compressed gas (carbon dioxide). A manual switch operated by the shooter allows to select one mode or the other, by connecting one stocking chamber with the compressed air or with the compressed air produced by pumping. When firing, the hammer hits a component of jack piston which releases the air or the gas under pressure towards the gun barrel.

None of the compressed air distributors described here above offers an automatic functioning mode. Furthermore, these very complicated devices are not compatible with the design of a distributor introduced in kit form. Then, in the armament field, for example, it is more and more desirable to proceed with functional simulations, that is to say, without launching a projectile, but by reproducing accurately all the normal functions of the weapon such as the displacement of the mobile parts together with the resulting recoil, the trigger pull weight etc. Such simulations call for example for the sending of a laser beam to the target. The laser beam can be triggered by an electric switch hit by a valve piston.

There is then a potential interest to develop an automatic jack system.

AIMS OF THE INVENTION

The present invention aims to provide a jack and its compressed gas distributor, preferably in line, offering a fully automatic functioning after activation by an initial impulse.

The invention has the additional aim to possibly supply, for some applications, such a jack together with its distributor, as a kit which can be easily adapted to existing equipment.

The invention also aims to supply such a distributor compact enough, that is to say, causing a very light increase of the jack length by integrating the distributor, simple and easy to produce.

Finally, the invention aims to propose an automatic pneumatic distributor to be used in many technical applications and not limited to the specific armament technical field.

SUMMARY OF THE INVENTION

The present invention relates to an automatic functioning device for distributing compressed gas, for example compressed air or compressed carbon dioxide, comprising a jack made of a cylinder in which can slide a piston having a piston head, a distributor with an intake of compressed gas fitting said cylinder at one front end to be sealed, called distributor support and a chamber, capable to contain said compressed gas under pressure and being dynamically located between the end of the cylinder to be sealed and the piston head.

The device of the invention additionally includes means for successively and automatically carrying out the following operations, after the piston has been initially struck on a rear end by a hammer:

- forward piston displacement, compressed gas intake into the chamber and pressurization of the latter;
- rearward recoil of the piston, release of the compressed gas contained in the chamber and depressurization of the latter;
- return of the piston to the front, closing of the compressed gas intake, release to the front of the remaining gas contained within the chamber and return of the device to its initial position.

According to one preferred embodiment of the invention, the device includes a valve capable of opening and closing along the cylinder axis and a double sealing ring allowing the opening and closing of the compressed gas intake, said valve being fitted with a first return spring such as, in its balanced position, it is disengaged from the double ring at its rear side, the double ring being fitted with a second return spring such as, in its balanced position, it seals the compressed gas intake.

Advantageously, the piston head can come in contact at the front of the cylinder with the valve which causes the joint recoil of said valve and the double ring fully against the distributor support which in turn causes compressed gas intake into the chamber.

Preferably, the piston is fitted with a return spring which tends to bring it back to its balanced position at the front of the cylinder.

According to the invention, at the time when the depressurization of the chamber occurs owing to the piston return to the rear, the gas under pressure escapes by the coming out of the piston out of the cylinder.

In an alternative preferred embodiment, at the time when the depressurization of the chamber occurs owing to the piston return to the rear, the gas under pressure escapes through an aperture located in the cylinder, the piston remaining in this case inside the cylinder.

Still according to the invention, the chamber being at most lightly pressurized and the piston being not in contact with the valve, said valve and said double ring are in their balanced position owing to the effect of their respective return springs and the valve is disengaged from the double ring which allows an escape of the gas contained in the chamber through an aperture located in the wall of the distributor support, said double ring being in a closing position of the pressurized gas intake.

According to a first embodiment, a distributor control is effected by contact between the piston and the valve by means of a striker capable of sliding freely inside the piston, after the rear side of the striker has been initially hit by the hammer.

According to a second embodiment, a distributor control is effected by a pulling device located in front of the assembly composed of the distributor and its jack.

The fact to offer a very compact assembly allows to considerably reduce losses of compressed air due to an otherwise great distance between the distributor and the jack.

Another advantage lies in the capability to re-cock very easily the distributor activation device by the piston recoil.

The device jack/distributor of the present invention is advantageously usable with pistol-type weapons (i.e. equipped with a slide) or with rifles (i.e. equipped with a breech block).

BRIEF DESCRIPTION OF THE DRAWINGS

The present invention will be described with reference to the accompanying drawings representing an exploded view together with its nomenclature and the positioning of the component parts according to the different steps of the basic principle, being understood that this principle can be adapted according to specific user requirements.

DESCRIPTION OF A PREFERRED EMBODIMENT OF THE INVENTION

Functioning Description

The device for the automatic distribution of compressed air, according to the invention, can be produced as a kit or integrated in any type of mechanism such as rifle or pistol, in particular for firing simulation or in any mechanism according to the possibilities of use of the invention advantages. The initial activation of the distributor is obtained by percussion of a striker 9 allowed to freely slide inside a piston 80 by means of a hammer 15 which can be an original part of a weapon or part of the device equipped with the automatic compressed air distributor according to the invention. The percussion is obtained by the forward revolving of the hammer 15 into a cavity of the piston body 8.

Figure 1:
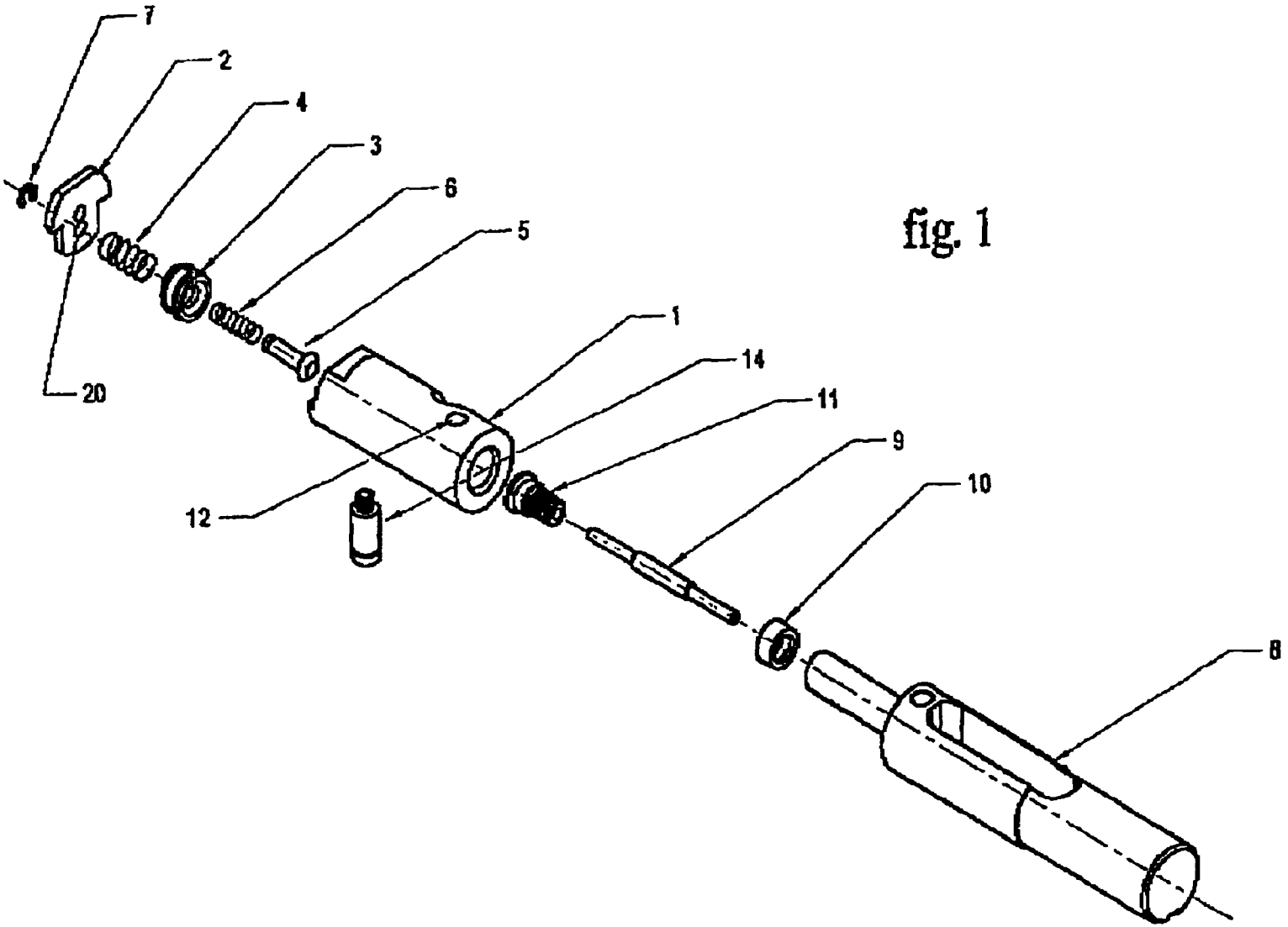
FIG. 1 represents an exploded view with nomenclature, following the actuating principle by a striker crossing the jack piston according to the invention.
Figure 2:
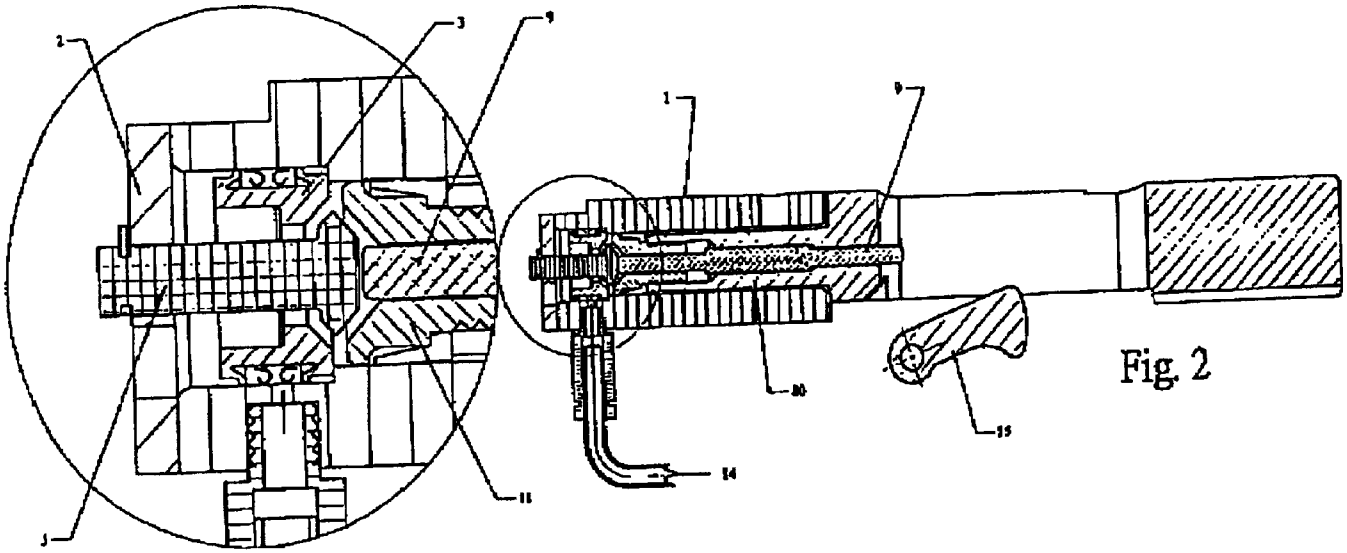
FIG. 2 represents a longitudinal cross-sectional view of the various components of the jack/distributor assembly shown in FIG. 1, and a detailed view, in resting position, with sealed compressed air intake.

In the resting position, or initial position (FIG. 2), the compressed air intake from any type of feeding device, through the joint or connection 14 is sealed by the double sealing ring of distribution 3.

Figure 3:
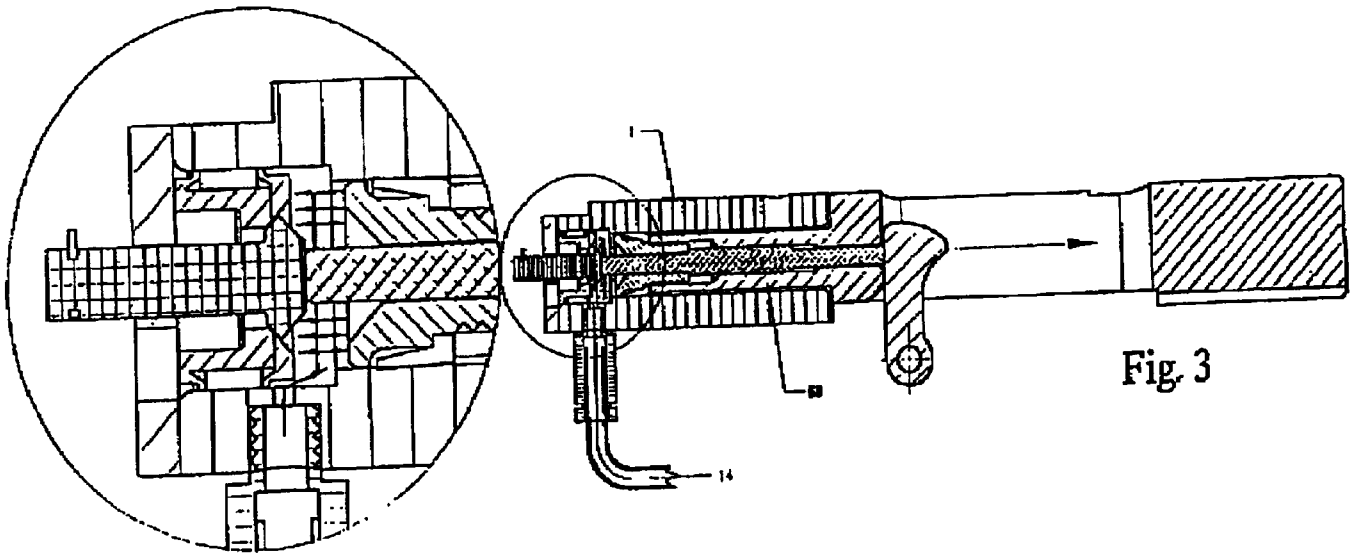
FIG. 3 represents a longitudinal cross-sectional view of the various components of the jack/distributor assembly shown in FIG. 1 and a detailed view in activation position of the distributor for air admission.

FIG. 3 represents the opening position of the air admission. In the present embodiment, example has been taken of an actuation by means of a striker 9 which goes through the piston jack 80 and is actuated by a hammer 15 which hits said striker. The latter transmits its linear displacement to the valve 5 of the distributor. The valve 5 comes then into contact with the distributor ring 3, the latter moving to the left, which allows the compressed air to pass in between the coupled assembly ring 3—valve 5 and the piston head 11 of the jack.

Figures 4, 5, 6:
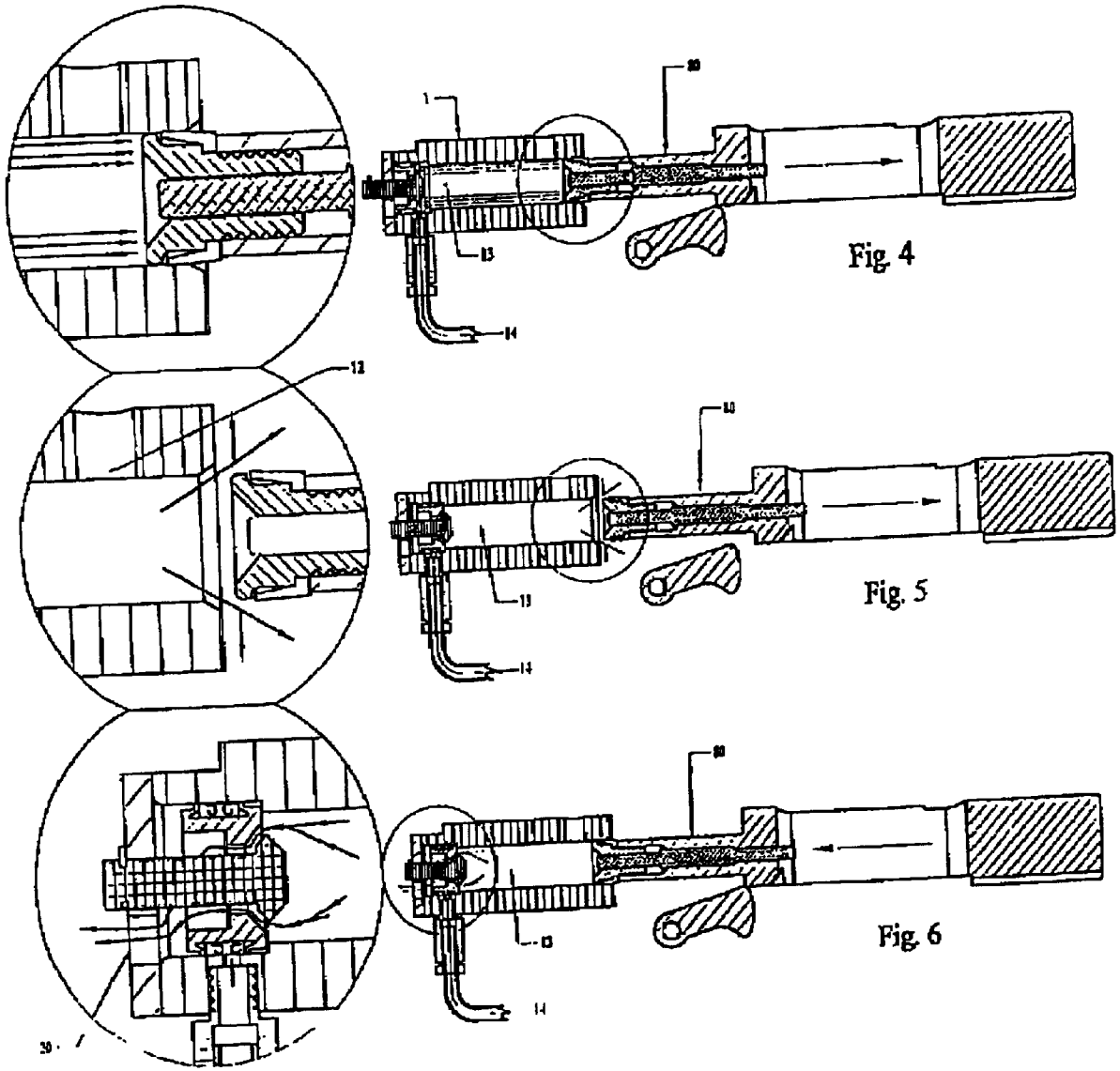
FIG. 4 represents a longitudinal cross-sectional view of the various components of the jack/distributor assembly shown in FIG. 1, and a detailed view, in recoil position of the piston, with compressed air admission in open position.
FIG. 5 represents a longitudinal cross-sectional view of the various components of the jack/distributor assembly shown in FIG. 1, and a detailed view, in a position wherein the piston is out of the jack tube, the air admission being sealed.
FIG. 6 represents a longitudinal cross-sectional view of the various components of the jack/distributor assembly shown in FIG. 1, and a detailed view in return position of the jack piston driven by its spring with a release of compressed air through the distributor.

Compressed air intake into cylinder 1 has for effect to maintain, by the pressure of the air which is compressed therein, the assembly 3,5 in a stop position fully to the left, against the distributor support 2, the air intake 14 remaining open and has also for effect the joint recoil to the right of the various component parts 8,9,10,11 of the jack piston 80 (FIG. 4).

FIG. 5 represents the position of depressurization in the jack. When the recoil of the jack piston 80 occurs, the latter can, either exit the jack tube or cylinder 1, or remain in the cylinder thanks to a lateral air exhaust 12 located in the jack tube 1. In both cases, the effect is a drop of pressure in the jack tube 1 and, at the same time, to reduce the pressure on the assembly composed of the distributor ring 3 and the valve 5. The assembly 3,5 can then, under the effect of the respective springs 4,6 of the two parts 3,5, resume its initial position to the right (FIG. 6), which closes the compressed air intake thanks to the circular double ring 3 of the distributor. This allows also the escape of the air still contained in chamber 13 at the time of the return of jack piston 80 which, moved by its spring (not shown) returns to its initial resting position to the left. The air escape, at the time of this return, is effected thanks to the disengagement of valve 5 away from the distributor ring 3 and through the lower hole 20 of the distributor support 2 (see detailed view on FIG. 6). The compressed air intake remains sealed at this point and the device has come back to its initial resting position. The complete sequence of the jack and distributor movements is thus automatically effected since it is only initiated by impulse of the hammer 15 without needing any other intervention.

The device has a universality criterion and it is thus obvious that the application referred to in the above-mentioned figures is simply given for illustration and example purposes only and that the principle can be adapted according to the specific user requirements.

For instance, the striker part 9 may be missing and replaced by a direct contact between the jack piston 80 and the valve 5, which would result to the fact that when the jack closes to the left, all the functions shown in FIGS. 3 to 6 would be automatically available. To stop the functioning cycle in this configuration, it is enough to interrupt the jack piston before its contact with valve 5.

The device of the invention can be produced in a kit form to directly fit into firing simulation weapons or to be adapted to any other mechanism, either as a kit, or integrated in a more complex assembly requiring or not modifications to the original device.

The jack/distributor of the invention presents, among others, the following advantages:

- great compactness due to a very light increase of the jack length by integration of the distributor;
- opening function of the compressed air intake with holding during the time of the piston displacement to the rear;
- automatic closing function of the compressed air intake by depression of the chamber;
- automatic air escape function when the piston goes back;
- possibility of production in a kit form;
- automatic re-cocking of the hammer;
- possibility to have the breech block in motion, not exclusively restricted to pneumatic feeding applications in gas or compressed air operated weapons.

The person skilled in the art will easily be capable to adapt the principle of the invention to the specific characteristics of a given product whilst keeping the same functioning principles.

Nomenclature

1. Jack cylinder
2. Distributor support
3. Distribution double sealing ring
4. Double ring spring
5. Valve
6. Valve spring
7. Locking ring
8. Piston body with central cavity
9. Striker
10 Piston joint
11 Piston head
12 Lateral aperture in cylinder
13 Chamber
14 Connection for compressed air intake
15 Actuating component (hammer)
20 Distributor support aperture
80 Piston (whole part)

What is claimed is:

1. A semi-automatic device for distributing compressed gas, comprising:

a pneumatic jack comprising a cylinder, having a front and a rear end, wherein a piston, having a piston head and a rear end, can slide;

a distributor, comprising a distributor support and a compressed gas intake means, wherein said distributor seals; said front end of said cylinder;

a chamber having a front end, capable of containing a compressed gas, located between said distributor support and said piston head;

means for successively and automatically carrying out the following operations after said rear end of said piston has been initially struck by a hammer:

a forward displacement of the piston from an initial equilibrium position, thereby causing a compressed gas intake into said chamber and a pressurization of said chamber;

a rearward recoil of the piston, thereby releasing said compressed gas from said rear end of said cylinder and depressurizing said chamber, said depressurization causing a closing of said compressed gas intake means;

a return of the piston toward its initial position and a release of any remaining gas contained within the chamber from said front end of said chamber.

2. Device according to claim 1, further comprising a valve capable of opening and closing along the cylinder axis and a double sealing ring allowing the opening and closing of the compressed gas intake means, said valve being fitted with a first return spring so that at the equilibrium the valve is disengaged from the double ring at its rear side, the double ring being fitted with a second return spring so as at the equilibrium the double ring seals the compressed gas intake.

3. Device according to claim 2, wherein the piston head is able to come in contact at the front end of the cylinder with said valve, causing a joint recoil of said valve and said double sealing ring fully against the distributor support, causing in turn compressed gas intake into the chamber.

4. Device according to claim 1, wherein, as the piston moves rearward in the cylinder, the gas under pressure escapes by a coming out of the piston at said rear end of the cylinder, causing depressurization of said chamber.

5. Device according to claim 1, wherein, as the piston moves rearward in the cylinder, the gas under pressure escapes through a lateral aperture located in the cylinder, causing depressurization of the chamber, the piston remaining inside the cylinder.

6. Device according to claim 1, wherein the piston is fitted with a return spring intended to bring it back to its equilibrium position at the front end of the cylinder.

7. Device according to claim 2, wherein the chamber being at most lightly pressurized and the piston being not in contact with the valve, said valve and said double ring are in their equilibrum position under the effect of their respective return springs and the valve is disengaged from the double ring which allows an escape of the gas contained in the chamber through an aperture located in the wall of the distributor support, said double ring being in a closing position of the compressed gas intake means.

8. Device according to claim 2, wherein a distributor control is effected by contact between the piston and the valve by means of a striker capable of sliding freely inside the piston, after the rear side of the striker has been initially bit by the hammer.

9. Device according to claim 2, wherein a distributor control is effected by a pulling device located in front of the assembly composed of the distributor and its jack.

10. Device according to claim 1, wherein the compressed gas is compressed air.

* * * * *